US010477910B2

(12) United States Patent
Cooper

(10) Patent No.: US 10,477,910 B2
(45) Date of Patent: Nov. 19, 2019

(54) FLEXIBLE SOLE AND UPPER FOR AN ARTICLE OF FOOTWEAR

(71) Applicant: NIKE, Inc., Beaverton, OR (US)

(72) Inventor: Aaron A C Cooper, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 35 days.

(21) Appl. No.: 15/699,146

(22) Filed: Sep. 8, 2017

(65) Prior Publication Data

US 2017/0367434 A1 Dec. 28, 2017

Related U.S. Application Data

(62) Division of application No. 14/206,400, filed on Mar. 12, 2014, now Pat. No. 9,801,426.

(60) Provisional application No. 61/789,201, filed on Mar. 15, 2013.

(51) Int. Cl.

| | |
|---|---|
| ***A43B 13/14*** | (2006.01) |
| ***A43B 1/00*** | (2006.01) |
| ***A43B 3/00*** | (2006.01) |
| ***A43B 13/12*** | (2006.01) |

(52) U.S. Cl.

CPC ..... *A43B 1/0009* (2013.01); *A43B 3/0057* (2013.01); *A43B 13/122* (2013.01); *A43B 13/125* (2013.01); *A43B 13/141* (2013.01)

(58) Field of Classification Search

CPC ..... A43B 13/12; A43B 13/122; A43B 13/125; A43B 13/141

USPC ..... 36/102

See application file for complete search history.

(56) References Cited

U.S. PATENT DOCUMENTS

| | | | | |
|---|---|---|---|---|
| 1,733,733 | A | | 10/1929 | Hess |
| 2,162,912 | A | | 6/1939 | Craver |
| 2,244,322 | A | | 6/1941 | Zoller et al. |
| 2,334,719 | A | | 11/1943 | Margolin |
| 2,432,533 | A | | 12/1947 | Margolin |
| 4,535,553 | A | | 8/1985 | Derderian et al. |
| 4,658,514 | A | | 4/1987 | Shin |
| 4,685,224 | A | | 8/1987 | Anger |
| 5,446,977 | A | | 9/1995 | Nagano et al. |
| D414,317 | S | * | 9/1999 | Lubart ..... D2/951 |
| 6,023,857 | A | | 2/2000 | Vizy et al. |
| D424,793 | S | * | 5/2000 | Lubart ..... D2/951 |
| 6,115,945 | A | * | 9/2000 | Ellis, III ..... A43B 13/04 36/102 |
| 6,519,873 | B1 | | 2/2003 | Buttigieg |

(Continued)

FOREIGN PATENT DOCUMENTS

| | | | |
|---|---|---|---|
| CN | 2244322 | Y | 1/1997 |
| GB | 919658 | A | 2/1963 |

(Continued)

*Primary Examiner* — Ted Kavanaugh

(74) *Attorney, Agent, or Firm* — Shook, Hardy & Bacon, LLP

(57) ABSTRACT

A midsole for an article of footwear is strategically incised or scored to produce various straight and arcuate lines. Straight lines are integrated widthwise between edges on an arch side on an outer side. Arcuate lines are integrated into various places at the top of a toe portion, with at least one extending down through a midpoint in a heel portion. The latter arcuate line maintains curvatures that parallel curvatures on the outer side at some places and the arch side at other places. Also crossing at the midpoint in the heel portion are intersecting lines.

16 Claims, 14 Drawing Sheets

(56) References Cited

U.S. PATENT DOCUMENTS

| | | | | |
|---|---|---|---|---|
| 6,519,876 | B1 | 2/2003 | Geer et al. | |
| D498,904 | S * | 11/2004 | Lee | D2/953 |
| 6,857,202 | B2 | 2/2005 | Pfander | |
| 7,555,851 | B2 | 7/2009 | Hazenberg et al. | |
| 7,591,919 | B2 | 9/2009 | Schindler et al. | |
| 7,752,772 | B2 * | 7/2010 | Hatfield | A43B 7/1415 36/29 |
| 8,555,525 | B2 | 10/2013 | Mahoney | |
| 9,668,542 | B2 * | 6/2017 | Lawless | A43B 13/223 |
| 2002/0088145 | A1 | 7/2002 | Clark et al. | |
| 2004/0221485 | A1 | 11/2004 | Pfander | |
| 2005/0016023 | A1 | 1/2005 | Burris et al. | |
| 2008/0229617 | A1 * | 9/2008 | Johnson | A43B 3/0057 36/102 |
| 2010/0269271 | A1 | 10/2010 | Kim et al. | |
| 2010/0299965 | A1 * | 12/2010 | Avar | A43B 5/06 36/102 |
| 2012/0180335 | A1 | 7/2012 | Mahoney | |
| 2014/0041261 | A1 * | 2/2014 | Walker | A43B 3/0057 36/25 R |
| 2014/0150297 | A1 * | 6/2014 | Holmes | A43B 13/125 36/103 |

FOREIGN PATENT DOCUMENTS

| | | | |
|---|---|---|---|
| KR | 20090111748 | A | 10/2009 |
| WO | 2008115743 | A1 | 9/2008 |
| WO | 2013019934 | A1 | 2/2013 |

* cited by examiner

LATERAL VIEW

MEDIAL VIEW

FLEXIBLE SOLE AND UPPER FOR AN ARTICLE OF FOOTWEAR

CROSS-REFERENCE TO RELATED APPLICATIONS

This application claims priority to U.S. Nonprovisional application Ser. No. 14/206,400, filed Mar. 12, 2014, and titled "Flexible Sole and Upper for an Article of Footwear", which claims priority to U.S. Provisional Application No. 61/789,201, filed Mar. 15, 2013, titled "Flexible Sole And Upper For An Article Of Footwear". Each of these identified applications is incorporated by reference herein in its entirety.

BACKGROUND

Footwear, such as shoes, nearly all include a sole for support that may be made of rubber, foam, or some other material. While offering support and comfort to people's feet, soles themselves are usually somewhat rigid for various reasons. For one, the sole must support a person's foot when walking and running across different surfaces that are not always even. Hiking, for example, challenges people to move across uneven wilderness that can require a person to climb hills, scale rocks, or otherwise move across uneven surfaces, none of which present perfectly flat surfaces for the sole of a shoe to land. Even activities as simple are running or walking often present terrain that is uneven, inclined, or declined in some manner. When a foot hits nonlevel surfaces, different areas of the foot absorb more force than others. So shoe soles must be flexible enough to fit feet contorting in different ways on nonlevel surfaces.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter. Instead, it is provided to explain several different examples of the present invention, but not all examples possible. Thus, this summary should not be relied on to limit claimed subject matter.

One aspect of the invention is directed to a shoe sole that includes various sipes (e.g., cut lines) are strategically integrated into the top and bottom surfaces of the midsole to provide flexibility in different directions. Further, it is contemplated that a plurality of sipes on the top surface are substantially parallel with a plurality of sipes on the bottom surface. Further yet, it is contemplated that the parallel sipes on the top surface are offset from the sipes on the bottom surface in a direction that is perpendicular to the direction that the sipes extend. Further yet, it is contemplated that an outsole having channels extending in a direction substantially parallel with those of the bottom sipes is also incorporated in aspects of the present invention.

BRIEF DESCRIPTION OF THE SEVERAL VIEWS OF THE DRAWINGS

The present invention is described in detail below with reference to the attached drawing figures, wherein.

DETAILED DESCRIPTION

Figure 1:
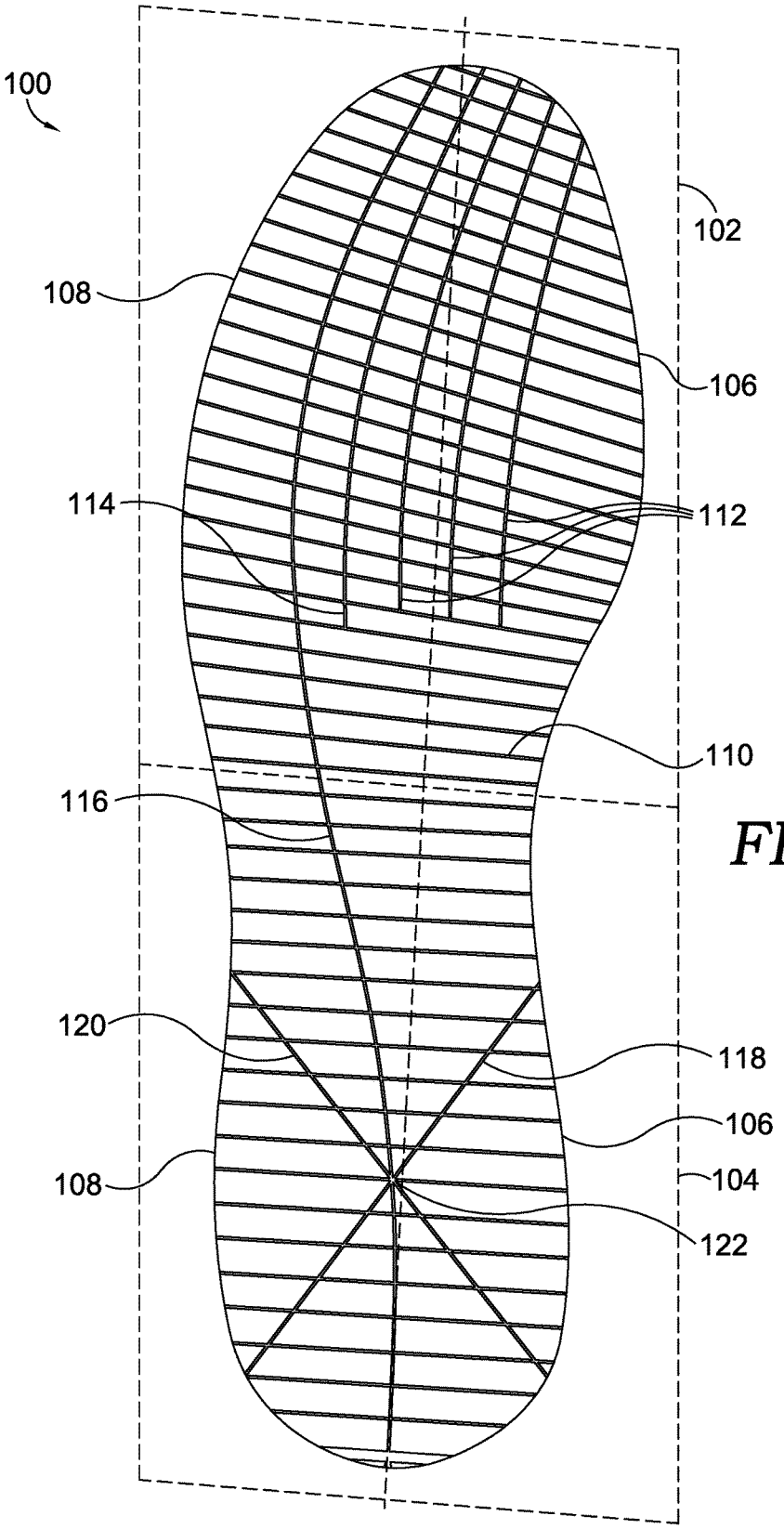
FIG. 1 illustrates a bottom view of a sole with strategically cut lines in the bottom in accordance with one example of the present invention.

The subject matter described herein is presented with specificity to meet statutory requirements. The description herein, however, is not intended to limit the scope of this patent. Instead, it is contemplated that the claimed subject matter might also be embodied in other ways, to include different steps or combinations of steps similar to the ones described in this document, in conjunction with other present or future technologies.

In general, the present invention is directed toward a shoe sole (referred to herein as simply a "sole") with various line segments cut (including scored, formed, or otherwise integrated therein) into a bottom and/or top surface of the sole. In particular, a midsole portion may be comprised of the one or more various line segments on a top and/or bottom surface of the midsole. The lines (e.g., channels, grooves, recess, cuts) are integrated into the sole for better flexibility and reduced weight across one or more portions of the sole. In one example, lateral (arch side toward an outer side) lines are integrated across the sole from side to side so that the heel and toe portions of the sole can more easily bend upwardly (e.g., top side) away from each other. Other examples include parallel-running, arcuately integrated lines in the upper toe portion of the sole and an arcuately integrated line running from a top edge of the toe portion to a bottom edge of the heel portion of the sole. Additionally, some examples may include lines integrated into the heel portion in a crisscross or pinwheel manner.

Before proceeding, some terminology should be clarified. "Soles," as discussed herein, refer to midsole portion of footwear, e.g., the portion of a shoe between an insole and an outsole. One skilled in the art will understand that an insole is the interior bottom of a shoe that sits directly beneath a person's foot under the footbed (commonly known as the sock liner), in an exemplary aspect. An insole may attach to a lasting margin of a shoe's upper that is wrapped around the last during the closing of the shoe during a lasting operation. Insoles can be made from cellulosic paper board, synthetic nonwoven insole board, or the like.

To add extra cushioning, a sole—which, again, is commonly known as the midsole—is often added underneath the insole for comfort; to control the shape, moisture, or smell of a shoe; or for health reasons like dealing with defects in the natural shape of the foot or positioning of the foot during standing, walking, running, etc. Soles may be made or integrated from foam, foam-cushioning sheets, latex, ethylene-vinyl acetate ("EVA"), polyurethane, plastic, thermoplastic, or a blend thereof. Soles may not be made entirely from one type of material, in an exemplary aspect. For instance, soles may comprise air or gel pockets for support and/or steel or plastic toes for protection. Other variations are also possible and will generally be understood and appreciated by those skilled in the art.

Connected to the bottoms of soles are "outsoles," which are layers of a shoe made for directly contacting the ground. Dress shoes often have leather or resin rubber outsoles, and casual or athletic shoes usually have outsoles made from natural rubber, plastic, or synthetic material like polyurethane. The outsole may comprise a single piece of material or may be an assembly of separate pieces of different materials. Additionally, outsoles may include different fixtures for various purposes, such as cleats for athletics, high heels or wood for fashion, tread, or the like. In particular, tread may be formed on outsoles in patterns to maximize gripping. For example, the tread of an outsole may include raised portions in circular, triangular, rectangular, pentagonal, hexagonal, octagonal, or other types of patterns. Examples of such patterns are shown in the accompanying drawings and discussed in greater length below.

Lines are integrated, cut, formed, and/or scored into soles according to the patterns and examples described herein. Integrated lines need not be discussed at length herein, as one skilled in the art will understand and appreciate that numerous machines and processes may be used to effectively integrate lines into a sole. Such integration may be performed by hand, by machine, and/or by either. For example, a conveyor may introduce soles to a laser cutting device that is computer controlled to integrate a specific patterns of lines. Or perhaps a worker may position soles underneath a cutting device and manually force the device to integrated or score the soles.

FIG. 1 illustrates a bottom view of a sole with strategically integrated lines in the bottom in accordance with one example of the present invention. Sole 100 includes at least two portions: toe portion 102 and heel portion 104. Toe portion 102 covers the anterior (e.g., toe end) half of sole 100 including the region designed to support a person's toes. Heel portion 104 covers the posterior half (e.g., heel end) of sole 100 including the region designed to support a person's heel. Sole 100 also includes two sides referred to herein as an arch side 106 (e.g., a medial side) and outer side 108 (e.g., a lateral side). Arch side 106 includes the edge of a sole 100 closest to a person's arch. Outer side 108 includes the opposite edge of sole 100, the one away from the person's arch.

Sole 100 includes several strategically integrated lines running across different portions and sides. Lateral lines 110 run widthwise from arch side 106 to outer side 108 in the toe portion 102 and/or heel portion 104. Lateral lines, in this example, are spaced evenly between one another. While not shown, some examples of the present invention may actually space lateral lines 110 in a manner that edges are closer together in the middle of arch side 106 and further apart in the upper region of outer side 108 to accommodate spacing around smaller and larger curves. In an actual shoe, lateral lines 110 may provide sole 100 greater flexibility for curling the shoe's heel and/or toe regions. Further, it is contemplated that the spacing, size, shape, and location of one or more lines may be different from those depicted herein.

Looking at toe portion 102, five lines (also referred to as arcuate sipes) are integrated extending from a forward toe edge of toe portion 102. The four rightmost arcuate lines (inner lines 112 and longer line 114) are parallel to one another and also substantially parallel to the curvature of outer side 108 in the same region of toe portion 102. Extending toward heel portion 104, inner lines 112 terminate at one lateral line 110, and the longer line 114 terminates at a more-healwardly lateral line 110. In this way, inner lines 112 may be referred to as a plurality of shorter arcuate sipes as each inner line 112 has a length that is less than longer line 114 as shown in FIG. 1. Both inner lines 112 and longer line 114 also traverse several lateral lines 110. It is contemplated that alternative lengths and combinations of lines may be implemented in accordance with aspects of the present invention.

Lengthwise line 116 (also referred to herein as first arcuate line) is next to longer line 114 and spans—across lateral lines 110—across both toe portion 102 and heel portion 104, extending from the toe edge and a heel edges of each portion, respectively. Lengthwise line 116 mimics and is substantially parallel to the curvature of outer side 108 in toe portion 102. As lengthwise line 116 extends into the heel portion 104, lengthwise line 116 includes a curvature in the opposite direction, i.e., curving to mimic and substantially parallel the curvature of arch side 106. As illustrated, lengthwise line 116 traverses more lateral lines 110 than longer line 114. In this way, longer line 114 may be referred to as an intermediate arcuate sipe with a length that is less than the length of lengthwise line 116 (i.e., first arcuate line) and that is greater than the lengths of the shorter arcuate lines.

Intersecting lines 118 and 120 traverse several lateral lines 110 so as to cross at a midpoint 122, which lengthwise line 116 also crosses. Intersecting lines 118 and 120 run diagonally between arch side 106 and outer side 108 in opposite directions. Intersecting line 118 runs from an upper region of arch side 106 to a lower region of outer side 108. Conversely, intersecting line 120 runs from an upper region of outer side 108 to a lower region of arch side 106.

Sole 100 merely illustrates a single example of the present invention. Alternative examples may include additional lines or exclude some of the lines shown in FIG. 1. Thus, the present invention may include a different number of lateral lines 110, inner lines 112, longer lines 114, lengthwise lines 116, or intersecting lines 118 and 120 than the number of each depicted. Likewise, different examples will include different numbers of spacing between the lines shown in sole 100. The different variations number far too many to list herein, but it should be noted that various examples of the present invention may include different placements and numbers of strategically integrated lines.

Not only do lateral lines 110 add flexibility so that sole 100 can better curl upward in the toe and heel portions, inner lines 112, longer line 114, and lengthwise line 116 increase flexibility of sole 100 widthwise, meaning arch side 106 and outer side 108 can more easily curl upward. Also, intersecting lines 118 and 120 work with lengthwise line 116 to increase flexibility downward in heel portion 104, allowing easier receipt and cushion of a person's heel. These are merely some of the benefits produced by the strategic lines to sole 100, and are listed here merely for explanatory purposes. The described benefits are by no means an exhaustive list and should not be used to limit claimed examples of the present invention to any particular benefit.

Figure 2:
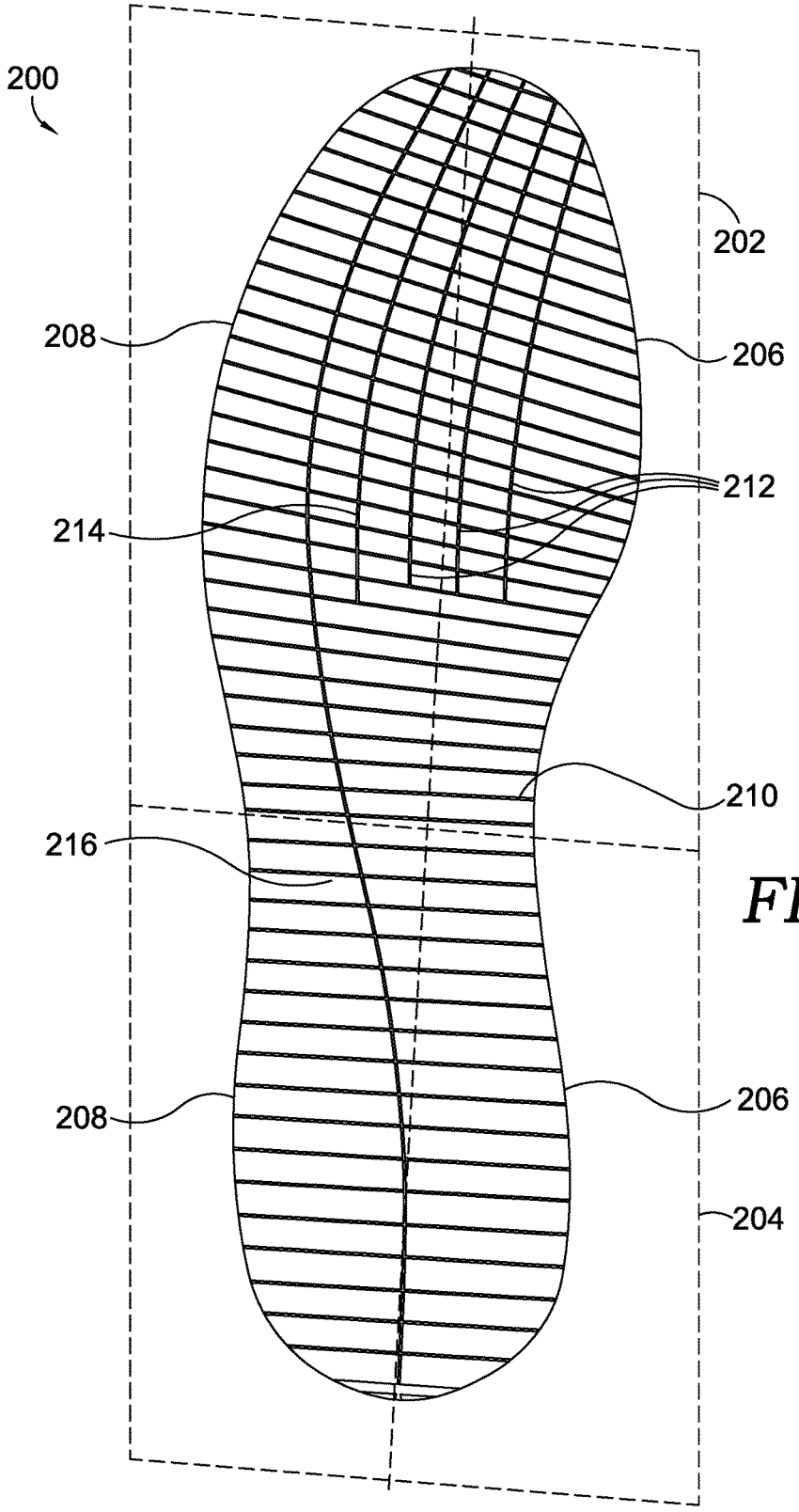
FIG. 2 illustrates a bottom view of a sole with strategically cut lines in accordance with an example of the present invention.

FIG. 2 illustrates a bottom view of a sole with strategically integrated lines in accordance with an example of the present invention. Sole 200 includes two portions: toe portion 202 and heel portion 204. Toe portion 202 covers the anterior half of sole 100 including the region designed to support a person's toes. Heel portion 204 covers the posterior half of sole 200 including the region designed to support a person's heel. Sole 200 also includes two sides referred to herein as an arch side 206 (i.e., medial) and outer side 208 (i.e., lateral). Arch side 206 includes the edge of sole 200 closest to a person's arch. Outer side 208 includes the opposite edge of sole 200, the one away from the person's arch.

Sole 200 includes several strategically integrated lines running across different portions and sides. Lateral lines 210 run widthwise from arch side 206 to outer side 208 in either toe portion 202 or heel portion 204. Lateral lines are spaced evenly between one another. While not shown, some examples of the present invention may actually space lateral lines 210 in a manner that edges are closer together in the middle of arch side 206 and further apart in the upper region of outer side 208 to accommodate spacing around smaller and larger curves. In an actual shoe, lateral lines 210 give sole 200 greater flexibility for curling the shoe's heel and/or toes.

Looking at toe portion 202, five lines are integrated to end at the top of toe portion 202. The four rightmost arcuate lines (inner lines 212 and longer line 214) are parallel to one another and also parallel the curvature of outer side 208 in the same region of toe portion 202. Flowing toward heel portion 204, inner lines 212 stop at one lateral line 210, and longer line 214 stops at the next successive lateral line 210. Both inner lines 212 and longer line 214 also traverse several lateral lines 210.

Lengthwise line 216 lies next to longer line 214 and spans—across lateral lines 210—into both toe portion 202 and heel portion 204, touching top and bottom edges of each portion, respectively. Lengthwise line 216 mimics and parallels the curvature of outer side 208 in toe portion 202. As lengthwise line 216 runs into heel portion 204, lengthwise line 216 includes a curvature in the opposite direction, i.e., curving to mimic and parallel the curvature of arch side 206.

Sole 200 merely illustrates a single example of the present invention. Alternative examples may include additional lines or exclude some of the lines shown in FIG. 2. Thus, the present invention may include a different number of lateral lines 210, inner lines 212, longer lines 214, or lengthwise lines 216 than the number of each depicted. Likewise, different examples will include different numbers of spacing between the lines shown in sole 100. The different variations number far too many to list herein, but it should be noted that various examples of the present invention may include different placements and numbers of strategically integrated lines.

Figure 3:
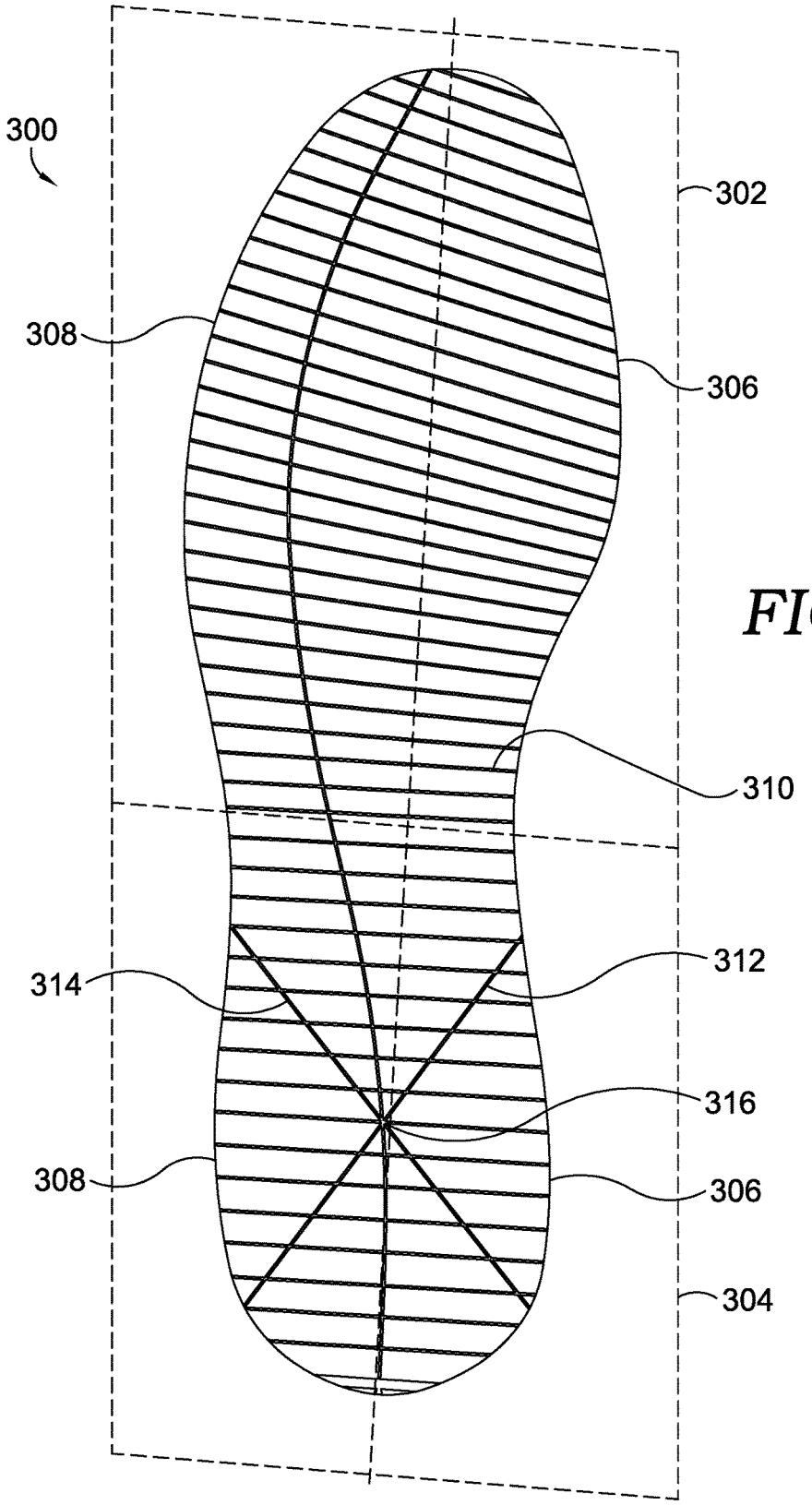
FIG. 3 illustrates a bottom view of a sole with strategically cut lines in accordance with an example of the present invention.

FIG. 3 illustrates a bottom view of a sole with strategically integrated lines in accordance with an example of the present invention. Sole 300 includes two portions: toe portion 302 and heel portion 304. Toe portion 302 covers the top half of sole 300 including the region designed to support a person's toes. Heel portion 304 covers the bottom half of sole 300 including the region designed to support a person's heel. Sole 300 also includes two sides referred to herein as an arch side 306 and outer side 308. Arch side 306 includes the edge of sole 300 closest to a person's arch. Outer side 308 includes the opposite edge of sole 300, the one away from the person's arch.

Sole 300 includes several strategically integrated lines running across different portions and sides. Lateral lines 310 run widthwise from arch side 306 to outer side 308 in either toe portion 302 or heel portion 304. Lateral lines are spaced evenly between one another. While not shown, some examples of the present invention may actually space lateral lines 310 in a manner that edges are closer together in the middle of arch side 306 and further apart in upper region of outer side 308 to accommodate spacing around smaller and larger curves. In an actual shoe, lateral lines 310 give sole 300 greater flexibility for curling the shoe's heel and/or toes.

Intersecting lines 312 and 314 traverse several lateral lines 310 so as to cross at midpoint 316. Intersecting lines 312 and 314 run diagonally between arch side 306 and outer side 308 in opposite directions. Intersecting line 312 runs from an upper region of arch side 306 to a lower region of outer side 308. Conversely, intersecting line 314 runs from an upper region of outer side 308 to a lower region of arch side 306.

Sole 300 merely illustrates a single example of the present invention. Alternative examples may include additional lines or exclude some of the lines shown in FIG. 3. Thus, the present invention may include a different number of lateral lines 310 and intersecting lines 312 and 314 than the number of each depicted. Likewise, different examples will include different numbers of spacing between the lines shown in sole 300. The different variations number far too many to list herein, but it should be noted that various examples of the present invention may include different placements and numbers of strategically integrated lines.

Figure 4:
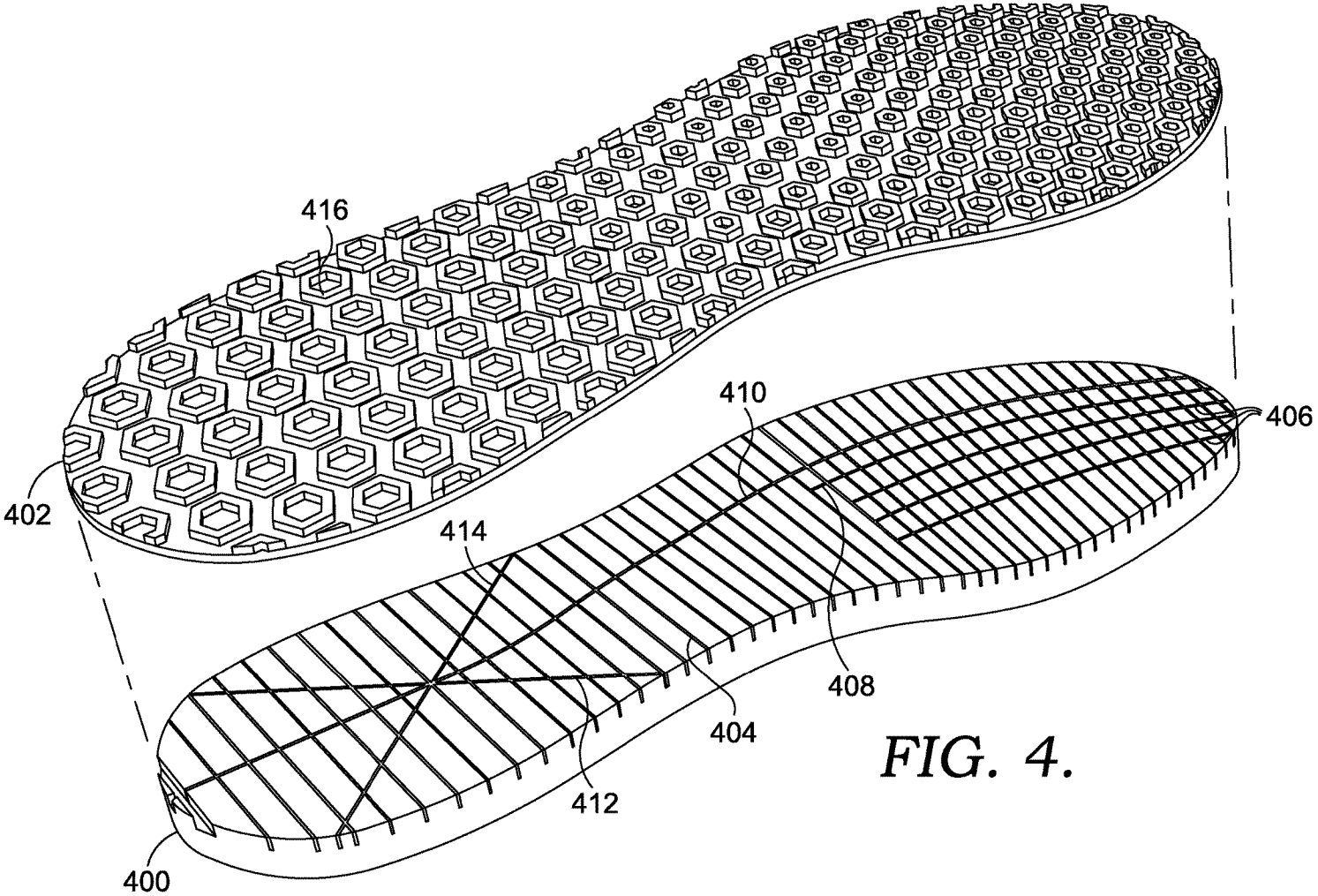
FIG. 4 illustrates an exploded view of a sole affixed to an outsole in accordance to one example of the present invention.

FIG. 4 illustrates an exploded view of a sole affixed to an outsole in accordance to one example of the present invention. Sole 400 is connected to outsole 402 by adhesive, gluing, sewing, fusion, or other technique for affixing outsoles to midsoles. Several types of integrated lines are included into an inferior surface of sole 400, which is then coupled to outsole 402 at a superior surface of the outsole 402. The lines of the inferior surface of the sole 400 include, but are not limited to: lateral lines 404, inner lines 406, longer line 408, lengthwise line 410, and intersecting lines 412 and 414. Each line runs across the inferior surface of sole 400 in a manner similar to the lines depicted in FIG. 1. Alternative line patterns may be used in other examples, such as, for example, those illustrated in FIGS. 2 and 3.

Outsole 402 includes treads 416 on an inferior surface, which are pictured as raised hexagonal shapes. Other examples will include different patterns or shapes of treads. For instance, treads need not be symmetrically positioned across outsole 402; instead, treads 416 may be positioned in an asymmetrical manner. Along the same lines, treads 416 may need to be positioned around other outsole features like cleats, plates, high heels, or the like. Treads 416 themselves may alternatively be formed as circles, triangles, rectangles, pentagons, octagons, or other shapes. In some examples, treads 416 may be inverted instead of raised or combinations of the two (inverted and raised) may be incorporated into outsole 402.

The integration of the outsole 402 with the sole 400 may provide one or more advantages. For example, the outsole 402 may be formed from a thin elastic material, such as a thermo/elastic polymer, that prevents one or more foreign objects from lodging or otherwise impaling the sole 400. In particular, the outsole 402 may be effective from allowing an object (e.g., rocks, stones, stick, mud) from being wedged and maintained between portions of the sole formed by the lines.

Figure 5A:
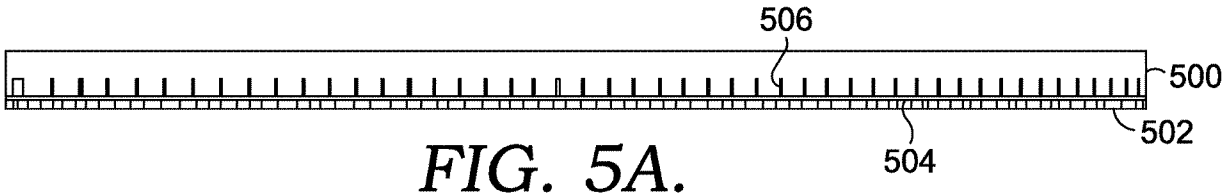
FIG. 5A illustrates a side view of an outsole affixed to a sole strategically cut with various lines in accordance with one embodiment.

FIG. 5A illustrates a side view of an outsole affixed to a sole strategically integrated with various lines in accordance with one example of the present invention. Sole 500 may be attached to outsole 502 using any of the aforementioned techniques (e.g., adhesion, gluing, sewing, fusion, etc.). Outsole 502 includes a pattern of outwardly extending treads 504, and sole 500 includes several integrated lines 506 that may include any of the lateral, inner, longer, lengthwise, or intersecting lines discussed herein, all of which are shown to be integrated into sole 500 to a certain depth (e.g., 0.5 mm). Any of the patterns of lines discussed herein may be used.

Figure 5B:
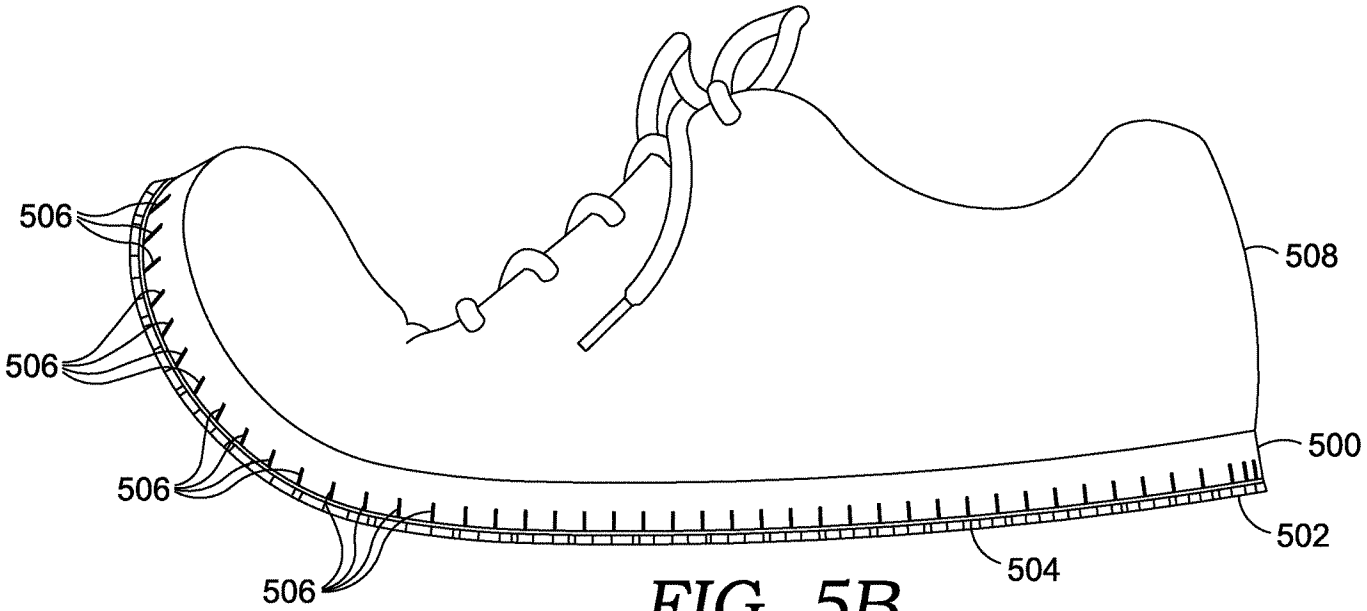
FIG. 5B illustrates a side view of an outsole affixed to a sole with a shoe also attached and stretched to curl the toe and heel portions upwards in accordance with one example of the present invention.

FIG. 5B illustrates a side view of outsole 502 affixed to sole 500 with a shoe 508 also attached and stretched to curl the toe and heel portions upward in accordance with one example of the present invention. As depicted, shoe 500 can easily stretch farther because lines 506 open fuller (e.g., the width between a first wall and a second wall of a line increases with the articulation of the sole) the farther shoe 508 stretches. While not shown, arcuate lines in sole 500 may also stretch to open fuller when different movements or pressures are put on sole 500. For example, a heel portion of sole 500 may depress further than normal in a middle region when a person's heel is in shoe 508, or perhaps when the person plants the heel firmly on sole 500. Or, in another example, a runner may get extra widthwise flexibility in shoe 508 on the balls of the runner's feet when the runner shifts laterally due to arcuate inner lines and/or one or more longer and lengthwise line.

FIGS. 6-20 depict an exemplary aspect of a dynamic shoe having the ability to adapt and move with a changing anatomy of a foot when in an as-worn position. In particular, the components of the footwear to be discussed hereinafter work in a harmonious manner to provide the freedom of movement desired. For example, the outsole, the midsole, and the strobel (in an exemplary aspect) are formed, sized, and assembled in a manner such that each compliments the motion and movement desired for the assembly as a whole. As will be illustrated and discussed, features of each component may be positioned, oriented, sized, and used in combination to achieve a holistic result of a flexible adaptable shoe and shoe sole.

Figure 6:
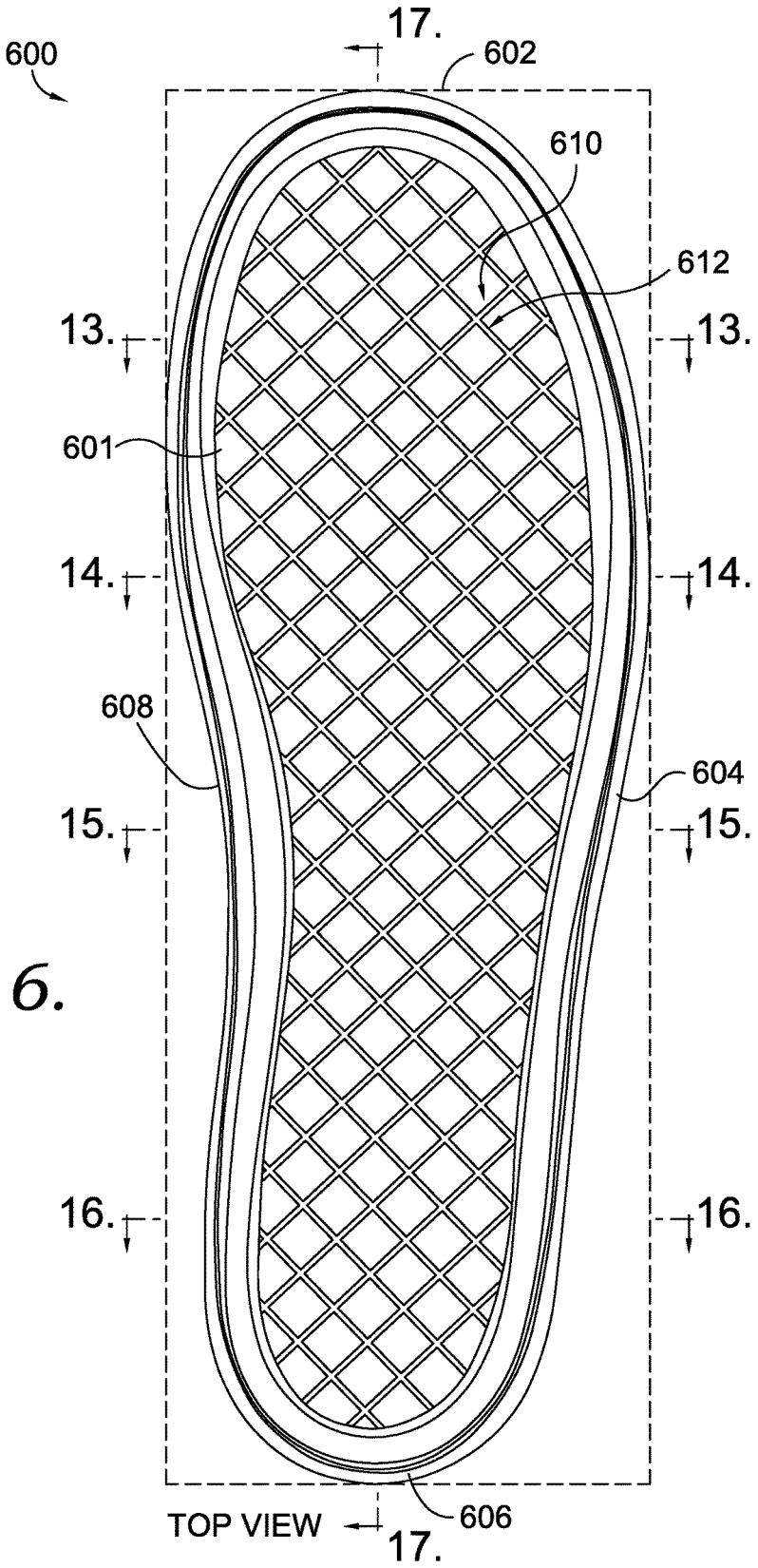
FIG. 6 depicts a superior (i.e., top) surface perspective of an exemplary midsole of a sole, in accordance with aspects of the present invention.

FIG. 6 depicts a superior (i.e., top) surface perspective of an exemplary midsole 601 of a sole 600, in accordance with aspects of the present invention. The midsole 601 is comprised of a toe end 602, an opposite heel end 606, a medial side 608, and an opposite lateral side 604. As previously discussed, the superior surface of a sole is the traditional top side of that sole. For example, a traditional strobel (or insole) contact the superior surface of a midsole while an outsole contacts the tradition inferior surface of a midsole.

The midsole 601 is comprised of a plurality of sipes (e.g., cuts, channels, gouges, recesses, lines). A sipe may be formed during a molding process of the article or as a post process application, such as application of a knife or laser to form the one or more sipes in one or more surfaces of the midsole 601. The sipes of the midsole 601, in this example, are arranged with a first grouping in a substantially parallel orientation to one another that generally extend from a medial-toewardly direction towards a lateral-heelwardly direction. A second grouping of side integrated into the midsole 601 superior surface are arranged in a substantially parallel orientation to one another that generally extend from a lateral-toewardly direction towards a medial heelwardly direction. Sipe 612 is an exemplary sipe of the first grouping and sipe 610 is an exemplary sipe of the second grouping. As a result, the first grouping of sipes and the second grouping of sipes are arranged in a substantially perpendicular orientation to one another. Further, the first grouping and the second grouping of sipes are oriented at an approximate 45 degree from an axis generally defined by the cutline 17-17.

As illustrated, the superior surface of the midsole 601 incorporates the first grouping of sipes and the second grouping of sipes across a substantial portion of a foot-support region of the midsole 601. A foot-supporting region is a portion of the midsole 601 in which the force of a wearer's foot transfers through the midsole 601 when in an at-rest position. Stated differently, the foot-supporting region is substantially adjacent to the bottom of a wearer's foot when in an as-worn position. Therefore, a perimeter region of the midsole 601 superior surface, in an exemplary aspect, is without one or more sipes. The termination of sipe at the perimeter region, in an exemplary aspect, provides structural integrity and medial/lateral support by providing a metered level of continuity as specified locations (e.g., the perimeter region) of the midsole 601. In the alternative, it is contemplated that one or more sipes on the superior surface (and/or the inferior surface) may extend all of the way to the edge of the midsole, in an exemplary aspect.

The midsole may be constructed from a variety of materials. For example, it is contemplated that an ethylene-vinyl acetate ("EVA") material may be utilized in the forming of the midsole 601. As previously discussed, it is desired to a level of elasticity/stretchability and flexibility in the midsole of the preset invention. However, EVA may not provide a desired quantitative value of elasticity and/or flexibility without mechanical enhancement. As such, it is contemplated that the strategic integration of sipes on the superior surface and/or the inferior surface (as will be discussed in FIG. 12 hereinafter) may allow an EVA-formed midsole to exhibit the desired amount of elasticity/stretchability and/or flexibility.

Figure 13:
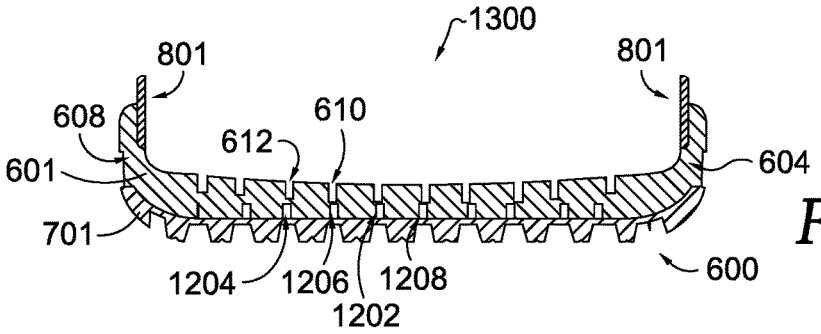
FIG. 13 depicts a cross-sectional view along cutline 13-13 of the sole depicted in FIG. 6, in accordance with aspects of the present invention.
Figure 14:
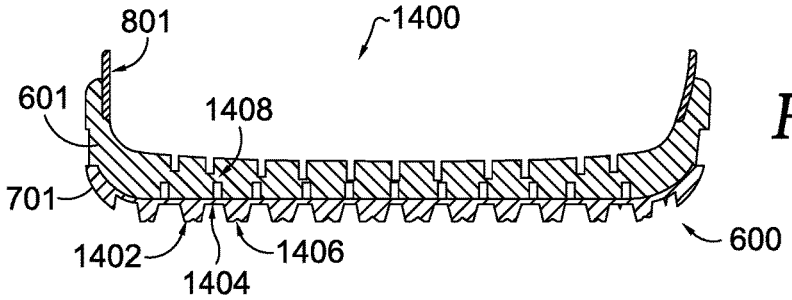
FIG. 14 depicts a cross-sectional view along cutline 14-14 of the sole depicted in FIG. 6, in accordance with aspects of the present invention.
Figure 15:
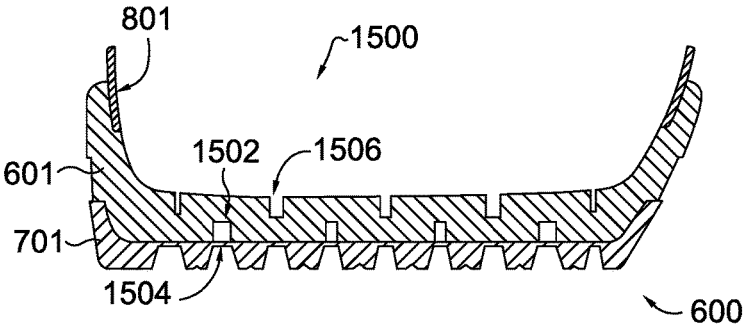
FIG. 15 depicts a cross-sectional view along cutline 15-15 of the sole depicted in FIG. 6, in accordance with aspects of the present invention.
Figure 16:
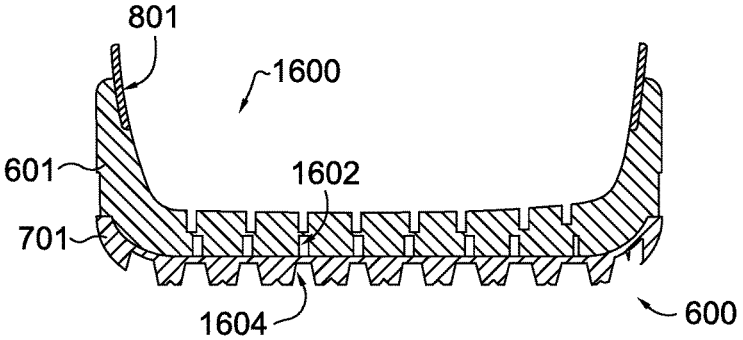
FIG. 16 depicts a cross-sectional view along cutline 16-16 of the sole depicted in FIG. 6, in accordance with aspects of the present invention.
Figure 17:
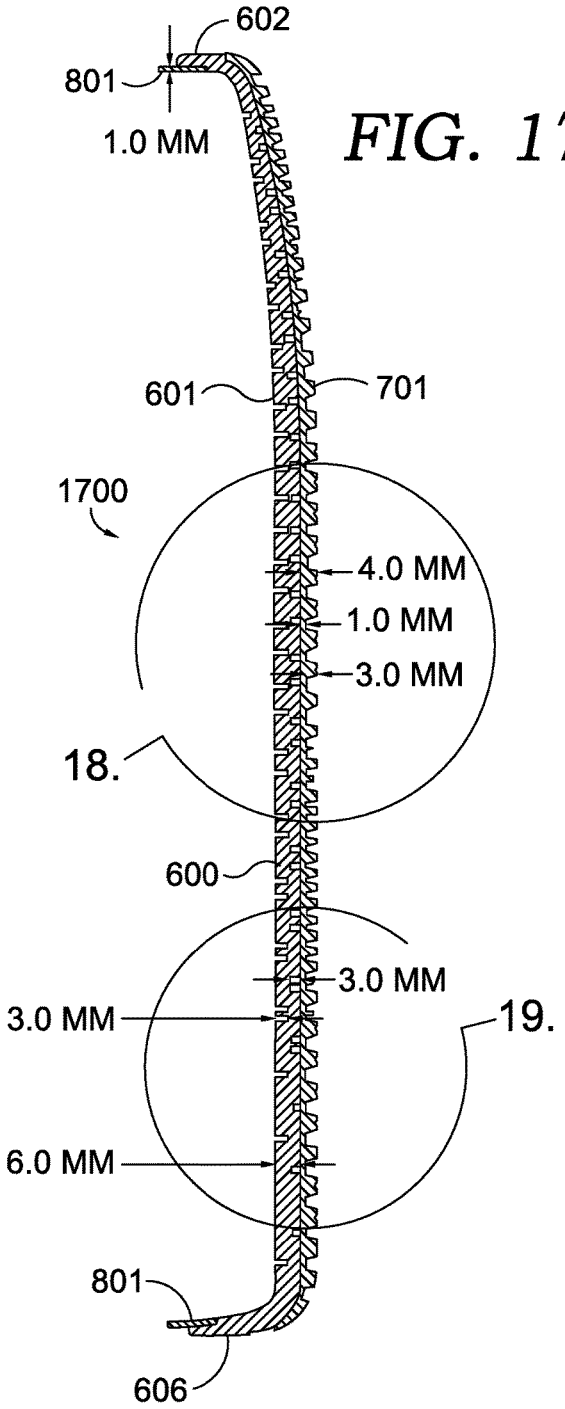
FIG. 17 depicts a cross-sectional view along cutline 17-17 of the sole depicted in FIG. 6, in accordance with aspects of the present invention.

FIG. 6 depicts a plurality of cutlines for depicting cross-section views of the illustrated sole 600 of FIG. 6. For example, cutline 17-17 extends from the toe end 602 to the heel end 606, and the cross-sectional view at cutline 17-17 is illustrated in FIG. 17 hereinafter. The cross-sectional view at cutline 13-13 is illustrated in FIG. 13 hereinafter. The cross-sectional view at cutline 14-14 is illustrated in FIG. 14 hereinafter. The cross-sectional view at cutline 15-15 is illustrated in FIG. 15 hereinafter. The cross-sectional view at cutline 16-16 is illustrated in FIG. 16 hereinafter.

Figure 7:
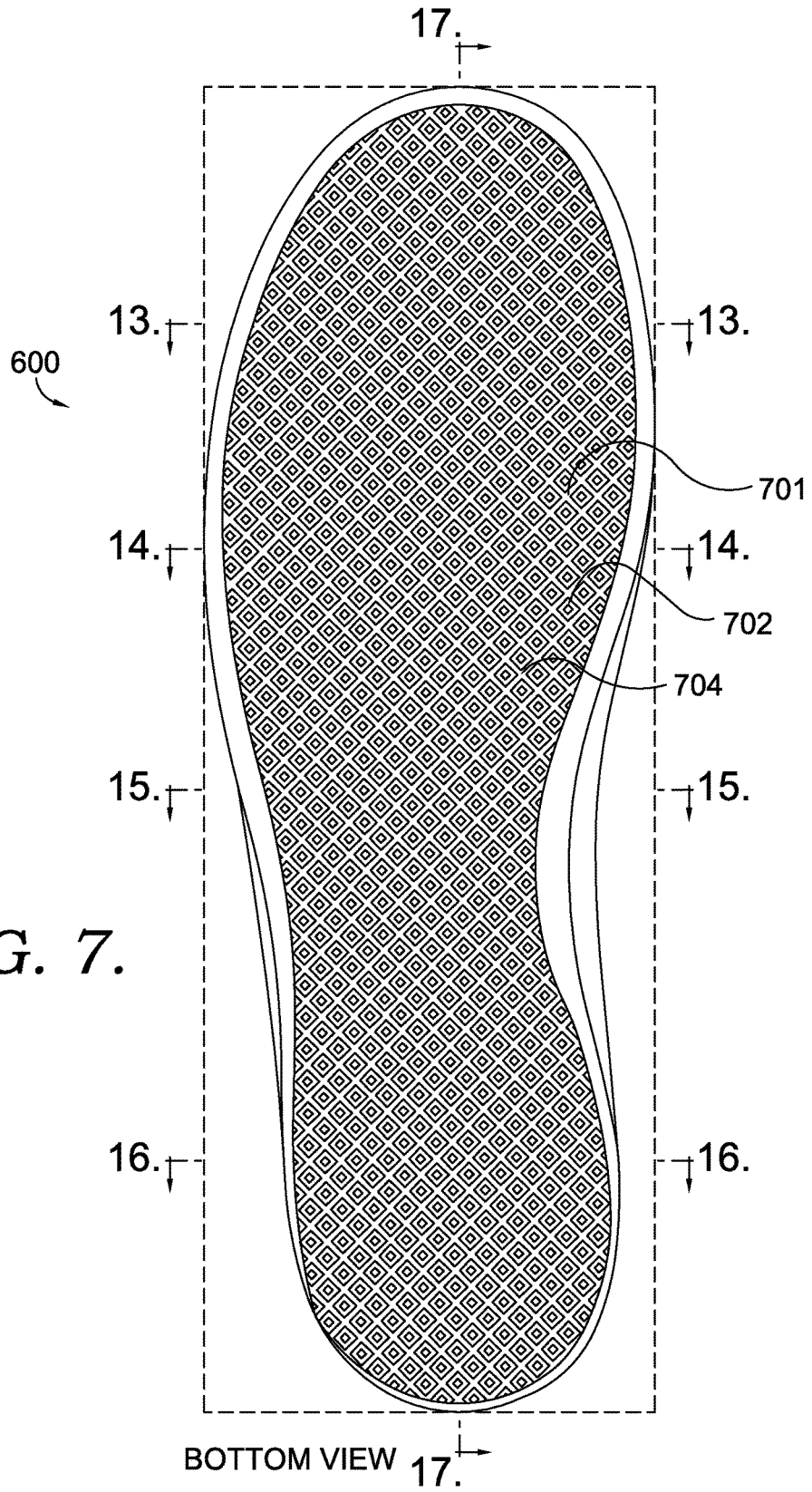
FIG. 7 depicts an inferior (i.e., bottom) perspective of an outsole of the sole, in accordance with one or more aspects of the present invention.

FIG. 7 depicts an inferior (i.e., bottom) perspective of an outsole 701 of the sole 600, in accordance with one or more aspects of the present invention. The outsole 701 is comprised of a plurality of treads (e.g., tread 702) separated by a plurality of channels (e.g., channel 704). The treads are protrusion-like features that extend outwardly (e.g., in an inferior direction) from the outsole webbing (e.g., the inferior surface of the channels). While the shape of the treads depicted are rectangular prisms (e.g., cuboids), it is contemplated that the treads may be of any shape (e.g., cylindrical). Further, while a particular size of treads on the inferior surface and a particular width of channels are depicted, it is contemplated that both the size and width may be altered, in exemplary aspects.

However, in the depicted aspect, the size of the treads and the channel width provide a functional characteristic. For example, of three substantially parallel channels, the first and the third channels have a distance substantially similar, in this example, to the distance between a first sipe and a second sipe of a common sipe grouping. It is contemplated that the orientation of the channels of the outsole 701 are aligned with orientation of the sipes of the midsole 601 of FIGS. 6 and 12, in an exemplary aspect. Further, as will be discussed in more detail hereinafter, it is contemplated that sipes on an inferior surface of the midsole 601 are aligned with and correspond to channels of the outsole 701, in an exemplary aspect. As will be appreciated, it is the orientational alignment of midsole sipes and outsole channels that may facilitate achieving a desired level of movement, responsiveness, and flexibility of the sole as a whole when coupled as an assembly. While specific sizes, orientations, and relationships are illustrated and depicted, it is contemplated that any size, shape, and alignment may be implemented in aspects of the present invention.

The outsole 701 may be formed from a variety of materials that provide a level of flexibility, elasticity, and responsiveness desired. For example, it is contemplated that a rubber (e.g., synthetic rubber) material formulated with a degree of stretchability is utilized to form the outsole. Further, it is contemplated that the outsole may be formed such that the webbing thickness (e.g., superior surface to the inferior surface of the channel portion) is approximately 1 millimeter. Further, it is contemplated that the tread is formed such that the tread thickness is about 4 millimeters from the superior surface to the distal end of the tread (e.g., or 3 millimeters from the inferior surface of the webbing to the tread distal end). The relatively minimal webbing thickness may achieve a desired characteristic of the outsole 701. While specific measurements are provided, it is contemplate that other sizes and ranges may be utilized in aspects of the present invention.

Figure 8:
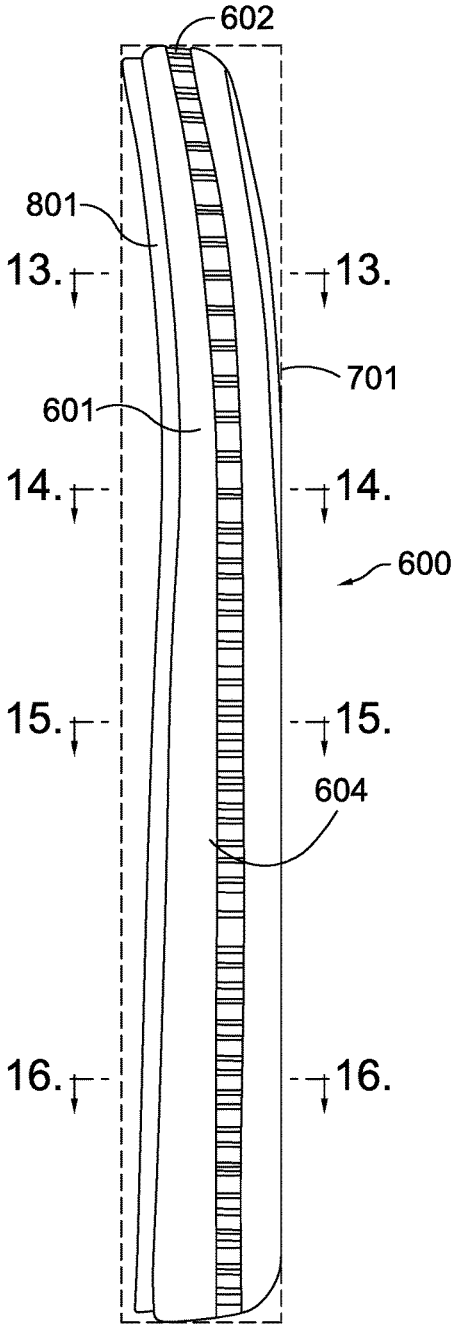
FIG. 8 depicts a lateral view of the sole, in accordance with aspects of the present invention.

FIG. 8 depicts a lateral view of the sole 600, in accordance with aspects of the present invention. In particular, the sole 600 is comprised of the outsole 701, the midsole 601, and a band 801. Also identified for orientation purposes are the toe end 602 and the lateral side 604.

The band 801 is a sole reinforcement feature that provides additional medial and lateral support to the sole 600. The band may extend along a perimeter region of the midsole 601 including the toe end 602, the lateral side 604, the heel end 606, and the medial side 608, in an exemplary aspect. The band 801, like other feature of the sole 600, in an exemplary aspect, incorporates flexibility and responsiveness into the assembly of the sole 600. Therefore, the band 801 may be formed from a material that has a modulus of elasticity that achieves a desired level of stretchability while still providing the desired sidewall and medial/lateral stability.

Figure 9:
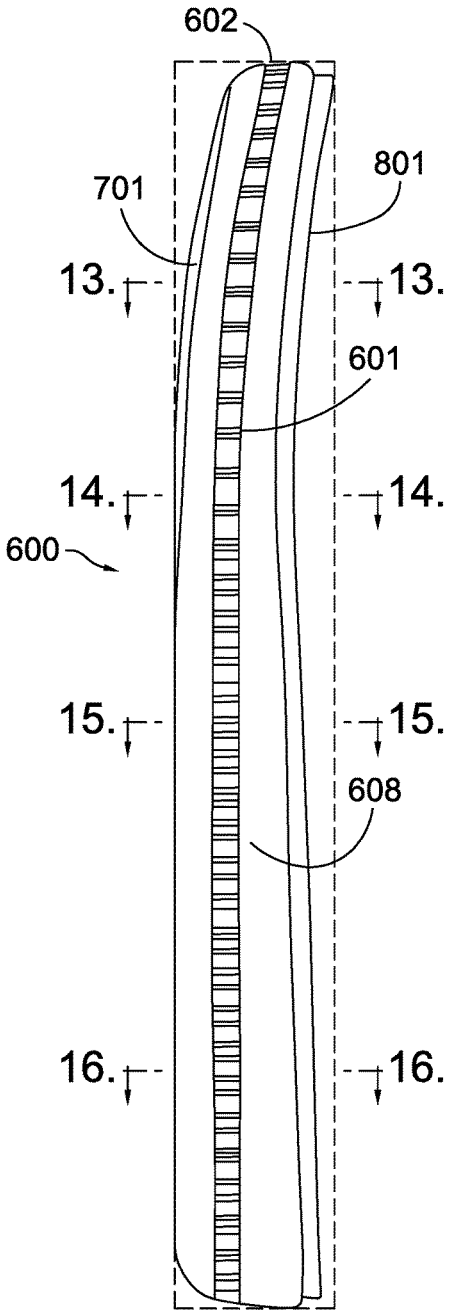
FIG. 9 depicts a medial view of the sole, in accordance with aspects of the present invention.

FIG. 9 depicts a medial view of the sole 600, in accordance with aspects of the present invention. In particular, the sole 600 is comprised of the outsole 701, the midsole 601, and the band 801. Also identified for orientation purposes are the toe end 602 and the medial side 608.

Figure 10:
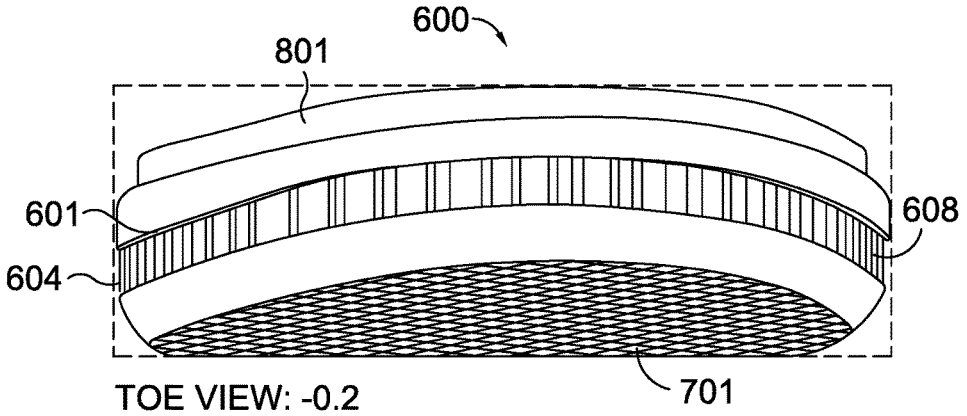
FIG. 10 depicts a toe-end view of the sole, in accordance with aspects of the present invention.

FIG. 10 depicts a toe-end view of the sole 600, in accordance with aspects of the present invention. In particular, the sole 600 is comprised of the outsole 701, the midsole 601, and the band 801. Also identified for orientation purposes are the medial side 608 and the lateral side 604.

Figure 11:
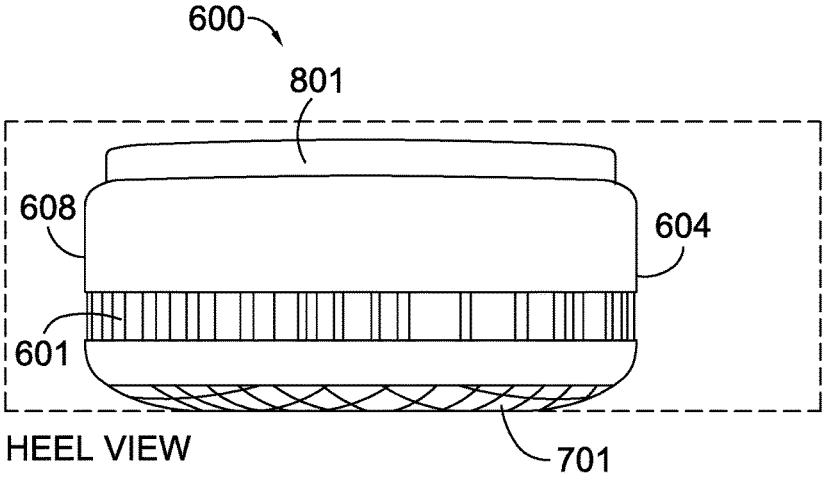
FIG. 11 depicts a heel-end view of the sole, in accordance with aspects of the present invention.

FIG. 11 depicts a heel-end view of the sole 600, in accordance with aspects of the present invention. In particular, the sole 600 is comprised of the outsole 701, the midsole 601, and the band 801. Also identified for orientation purposes are the medial side 608 and the lateral side 604.

Figure 12:
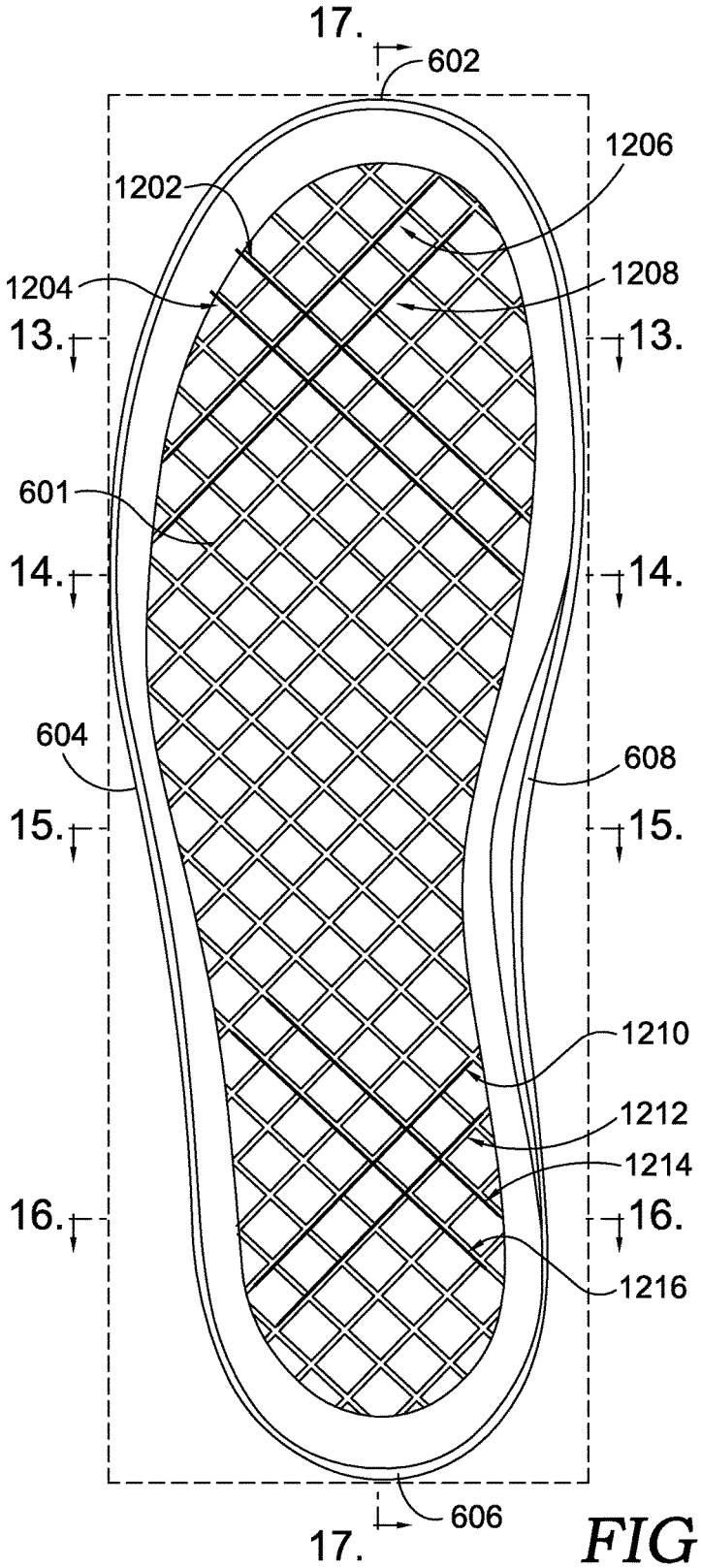
FIG. 12 depicts an inferior surface of the midsole, in accordance with aspects of the present invention.

FIG. 12 depicts an inferior surface of the midsole 601, in accordance with aspects of the present invention. The midsole 601 is formed with the toe end 602, the medial side 608, the heel end 606, and the lateral side 604. Further, the inferior surface is comprised of a plurality of sipes, such as those discussed with respect to FIG. 6 on the superior surface of the midsole 601.

In particular, the sipes of the inferior surface as depicted are comprised of a first grouping in a substantially parallel orientation to one another that generally extend from a medial-toewardly direction towards a lateral-heelwardly direction. A second grouping of sipes integrated into the midsole 601 inferior surface are arranged in a substantially parallel orientation to one another that generally extend from a lateral-toewardly direction towards a medial heelwardly direction. Sipes 1206, 1208, 1210, and 1212 are exemplary sipes of the first grouping and sipes 1202, 1204, 1214, and 1216 are exemplary sipes of the second grouping. As a result, the first grouping of sipes and the second grouping of sipes are arranged in a substantially perpendicular orientation to one another. Further, the first grouping and the second grouping of sipes are oriented at an approximate 45 degree from an axis generally defined by the cutline 17-17. Sipes 1202, 1204, 1206, 1208, 1210, 1212, 1214, and 1216 emphasized in FIG. 12 for illustration purposes only. It is contemplated, as depicted, the inferior surface incorporates sipes across the foot-supporting portion of the inferior surface, similar to that discussed with respect to the superior surface at FIG. 6 hereinabove.

In an exemplary aspect, the sipes of the superior surface and the sipe of the inferior surface are offset from one another, as depicted in FIG. 15 hereinafter. Further, it is contemplated that the offset is approximately half the distance between sipe of a common grouping (e.g., half the distance between 1206 and 1208). Further, it is contemplated that a similar distance is maintained between sipes within a grouping of sipes on the superior surface as to the distance maintained between sipes within a grouping of sipes on the inferior surface. Stated differently, it is contemplated in an exemplary aspect that the orientation relative to other sipes on the same surface, the orientation relative to the midsole 601, and the sizing of sipes are maintained consistent between sipes on the superior surface and sipes on the inferior surface. However, it is also contemplated that groupings of sipes on the superior surface and groupings of sipes on the inferior surface are not aligned in a superior-inferior direction, but instead are offset from one another. This offsetting of sipes established an accordion-like effect that allows the midsole to stretch and conform to a dynamic environment and dynamic foot.

FIG. 13 depicts a cross-sectional view 1300 along cutline 13-13 of the sole 600, in accordance with aspects of the present invention. The sole is depicted as being comprised of the outsole 701, the midsole 601, and the band 801. Further, the sole 600 is defined in part, with the lateral side 604 and the medial side 608.

The cross-sectional view 1300 depicts a plurality of sipes on the superior surface of the midsole 601, such as the sipe 610 and the sipe 612, both previously identified in FIG. 6. Further, the midsole 601 is comprised of a plurality of sipes on the inferior surface, such as sipes 1202, 1204, 1206, and 1208, which were previously identified in FIG. 12

FIG. 14 depicts a cross-sectional view 1400 along cutline 14-14 of the sole 600, in accordance with aspects of the present invention. The sole is depicted as being comprised of the outsole 701, the midsole 601, and the band 801.

The cross-sectional view 1400 depicts an exemplary relationship between sipes on the inferior surface of the midsole 601 and corresponding channels of the outsole 701. For example, an inferior sipe 1408 is relationally oriented superior to a channel 1404 of the outsole 701. The channel 1404 is formed between treads, such as treads 1402 and 1406. As previously discussed, it is contemplated that sipes on the inferior surface of the midsole may align with and be oriented to correspond with channels on the outsole inferior surface. In this example, it is contemplated that alignment of a flexible region of the midsole formed by the inferior sipes with a flexible region of the outsole formed by the channels allows for the sole assembly to respond and flex in a manner that adapts with a dynamic environment. As depicted in FIGS. 13-16, there is a substantial alignment of inferior sipes on the midsole 601 with channels on the outsole 701 across the width of the sole. However, it is contemplated that aspects of the present invention implement an offset of features (e.g., sipe, channels) and/or are indifferent to the alignment/relationship among features.

FIG. 15 depicts a cross-sectional view 1500 along cutline 15-15 of the sole 600, in accordance with aspects of the present invention. The sole is depicted as being comprised of the outsole 701, the midsole 601, and the band 801. Cross-sectional view 1500 depicts the exemplary offset between superior surface sipes and inferior surface sipes of the midsole 601. For example, as cutline 15-15 crosses sipes on the superior midsole surface at an intersection between the first grouping and the second groupings (e.g., as best illustrated on FIG. 6) and the cutline 15-15 also crosses sipes on the inferior midsole surface at an intersection between the first grouping and the second grouping (e.g., as best illustrated on FIG. 12), the offset nature of the inferior and superior sipes on the midsole is clearly depicted. It is the offsetting of the sipes that provides, in this exemplary aspect, an accordion-like effect to the midsole that provides a mechanically-introduced stretchability to the component. The stretchability introduced, is not limited in a specific direction (e.g., toe to heel or medial to lateral) because of the interaction between the siping geometry of the midsole and the channel geometry of the outsole (e.g., alignment of a channel 1504 in the outsole 701 with the inferior sipe 1502), in this example. However, as indicated throughout, it is contemplated that additional configuration that may or may not utilize corresponding geometries and or alignment may be implemented as well.

FIG. 16 depicts a cross-sectional view 1600 along cutline 16-16 of the sole 600, in accordance with aspects of the present invention. The sole is depicted as being comprised of the outsole 701, the midsole 601, and the band 801. Further, an exemplary inferior surface sipe 1602 is depicted as being in alignment with an outsole channel 1604.

FIG. 17 depicts a cross-sectional view 1700 along cutline 17-17 of the sole 600, in accordance with aspects of the present invention. The sole is depicted as being comprised of the outsole 701, the midsole 601, and the band 801. Further, the sole 600 is defined in part, with the toe end 602 and the heel end 606. Further, a focus region 18 is depicted. Focus region 18 is expanded in FIG. 18 hereinafter. Additionally, a focus region 19 is depicted. Focus region 19 is expanded in FIG. 19 hereinafter.

Figure 18:
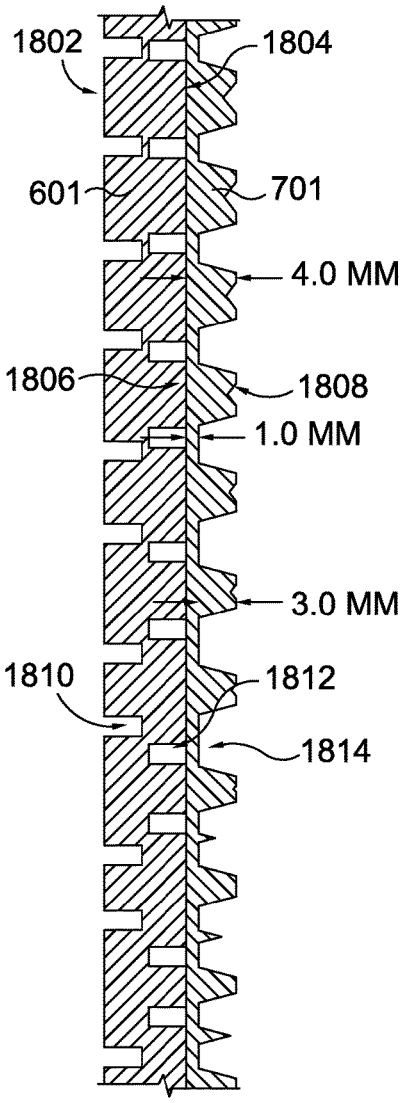
FIG. 18 depicts the focus region 18 of FIG. 17 along cutline 17-17 of the sole depicted in FIG. 6, in accordance with aspects of the present invention.

FIG. 18 depicts the focus region 18 of FIG. 17 along cutline 17-17 of the sole 600, in accordance with aspects of the present invention. In particular, the midsole 601 and the outsole 701 are illustrated. The midsole 601 is comprised of a midsole superior surface 1802 and a midsole inferior surface 1804. Further, the midsole 601 is comprised of a plurality of sipes on the midsole superior surface 1802, such as the superior sipe 1810. Similarly, the midsole inferior surface 1804 is comprised of a plurality of sipes, such as the inferior sipe 1812.

The outsole 701 is comprised of a superior surface 1806 and an opposite inferior surface 1808. Further, the outsole 701 is comprised of a channel 1814. In an exemplary aspect, the midsole inferior surface 1804 is couple with the outsole superior surface 1806 forming the sole as a whole. Exemplary dimensions are depicted. For example, 4.0 millimeters between the outsole inferior and superior surfaces 1808 and 1806 respectively. A measurement of 1.0 millimeter between as the thickness of the outsole webbing. And a 3.0 millimeter measurement of a tread protrusion from the webbing. However, it is contemplated that the dimensions of one or more portions may diverge from those depicted.

Figure 19:
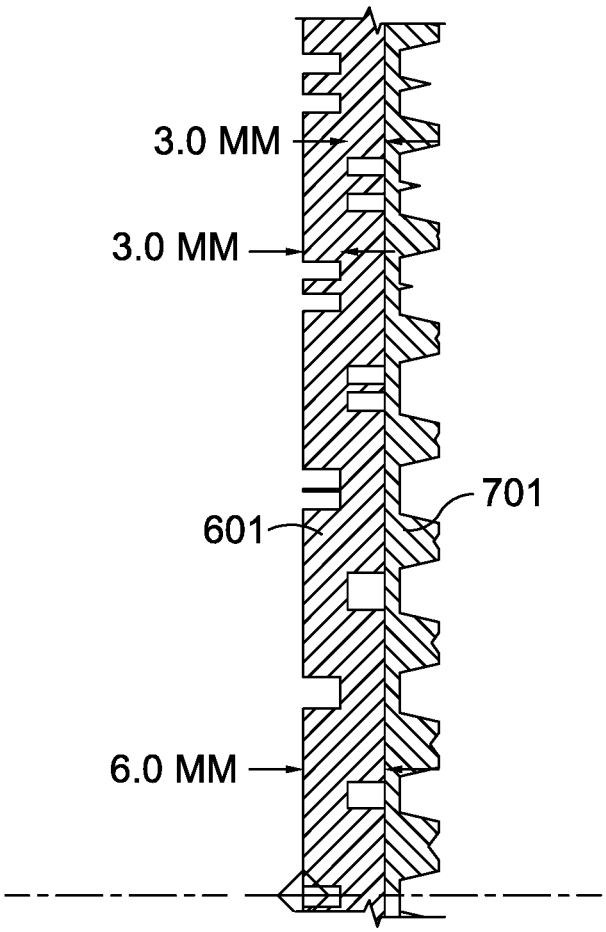
FIG. 19 depicts the focus region 19 of FIG. 17 along cutline 17-17 of the sole depicted in FIG. 6, in accordance with aspects of the present invention.

FIG. 19 depicts the focus region 19 of FIG. 17 along cutline 17-17 of the sole 600, in accordance with aspects of the present invention. In particular, the midsole 601 and the outsole 701 are illustrated. Exemplary dimensions are illustrated. For example, a 3.0 millimeter inferior sipe depth is depicted. Similarly, a 3.0 millimeter superior sipe depth is also depicted. Lastly, an overall posterior to inferior midsole dimension of 6.0 millimeters is depicted. However, it is contemplated that the dimensions of one or more portions may diverge from those depicted.

While a uniform pattern of siping and channels have been illustrated with respect to FIGS. 6-19, it is contemplated that variations may be introduced. For example, if a gradient stretchability is desired, it is contemplated that the size, shape, relative position, and relative orientation of siping and/or channels may be adjusted to achieve a desired degree of stretchability and responsiveness. For example, a zonal variation in siping and/or channeling may be implemented to reduce stretchability in a first zone by affecting the mechanical properties of the midsole, outsole, and/or strobel relative to other zones.

Figure 20:
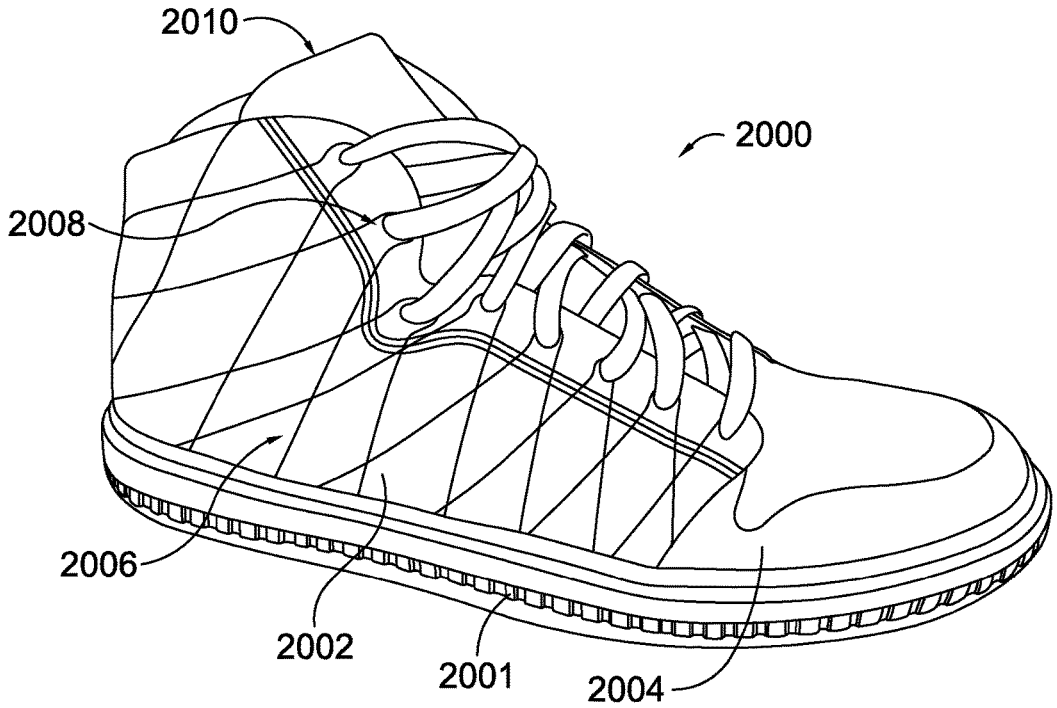
FIG. 20 depicts an article of footwear incorporating dynamic elements, in accordance with aspects of the present invention.

FIG. 20 depicts an article of footwear 2000 incorporating dynamic elements, in accordance with aspects of the present invention. The footwear (referred to as a "shoe" hereinafter) 2000 is comprised of a sole 2001, a dynamic upper portion 2002, and a static upper portion 2004.

The sole 2001 is comprised of a midsole and an outsole, such as the sole 600 discussed in connection with FIGS. 6-19. The dynamic upper portion 2002 is comprised of a high tensile strength thread, such as a nylon-based material. An example of the high tensile strength thread is thread 2006. The thread 2006 is effective to transfer a load applied by a lacing mechanism (e.g., a lacing eyelet 2008 around which the thread 2006 extends) around a wearer's foot when in an as-worn position to provide support and structure to the dynamic upper 2002. As a result, it is contemplated that when the dynamic upper portion 2002 is incorporated with the sole 2001, which is also flexible, stretchable, and adaptable, the shoe 2000 provides a dynamic response to the movement of the foot and the shoe.

The thread 2006 may be incorporated within the upper using a sewing and/or embroider-like machine. Further, it is contemplated that the thread 2006 is incorporated into the shoe 2000 such that a first thread (e.g., spool thread) has a first diameter and a second thread (e.g., bobbin thread has a second diameter). In an exemplary aspect, the first thread is a larger diameter providing a greater tensile strength than a smaller diameter second thread. Utilizing a different diameter (or other characteristics—material, twist, and tension) in one of the two threads needed to integrate the thread 2006 into the upper may reduce weight while providing a greater level of structural support to the shoe 2000.

Further, it is contemplated that a sock-like liner having flexible support may be integrated into the shoe 2000. For example, a liner 2010 is depicted as being included within the internal cavity of the shoe 2000 and extending upwardly from a strobel stitch (in this example) towards an ankle opening. The liner 2010 may be formed from a foam-like material having a lattice-like structure maintained between stretchable materials. This laminated structure of the liner 2010 provides a supporting and compressive result while maintain a flexible and dynamic nature to the shoe 2000.

While not depicted, the strobel board is a material that extends across the foot bed of the shoe 2000 allowing for the portions of the upper to be formed into a cohesive structure, in an exemplary aspect. It is contemplated that a multi-directional stretch material is incorporated into the strobel board so as to further facilitate a flexible and adaptable shoe. Further, it is contemplated that the strobel material is incorporated into the upper at a bias to a toe-to heel direction. Stated differently, it is contemplated that a warp and/or a weft of the strobel board material may be at an approximate 45 degree angle to an axis extending from the toe end to the heel end of the shoe in which the strobel is integrated. While a strobel technique is implied, it is contemplated that any shoe manufacturing technique may be implemented and a strobel board may be omitted all together.

The strobel material, in an exemplary aspect, is coupled to the superior surface of the midsole. It is contemplated that a flexible adhesive is applied that allows for the translation of flexibility and movement from the sole through the strobel and the connected upper. Therefore, it is contemplated that the combination of features may be integrated to provide a flexible and dynamic shoe that is responsive to changing environments, terrain, and anatomical form.

The present invention has been described in relation to particular embodiments, which are intended in all respects to illustrate rather than restrict. Alternative embodiments will become apparent to those skilled in the art that do not depart from its scope. Many alternative embodiments exist, but are not included because of the nature of this invention.

Although the subject matter has been described in language specific to structural features and methodological acts, it is to be understood that the subject matter defined in the appended claims is not necessarily limited to the specific features or acts described above. Instead, the specific features and acts described above are disclosed as example forms of implementing the claims.

The invention claimed is:

1. A midsole for an article of footwear, the midsole comprising:

a midsole body comprising a toe portion, a midfoot portion, and a heel portion;

a first surface and a second surface opposite the first surface, the midsole body extending between the first surface and the second surface; and a plurality of sipes extending from the first surface into the midsole body, the plurality of sipes comprising:

a plurality of arcuate sipes extending longitudinally, wherein the plurality of arcuate sipes comprises a first arcuate sipe having a first length extending from the toe portion to the heel portion, an intermediate arcuate sipe having a second length that is shorter than the first length, and a plurality of shorter arcuate sipes each having a third length that is shorter than the second length, and a first diagonal sipe and a second diagonal sipe, the first diagonal sipe intersecting the second diagonal sipe, wherein the first arcuate sipe intersects the first diagonal sipe and the second diagonal sipe at a location in which the first diagonal sipe intersects with the second sipe, wherein the intermediate arcuate sipe, the plurality of shorter arcuate sipes, and at least a portion of the first arcuate sipe are parallel to a curvature of a lateral edge of the midsole.

2. The midsole of claim 1, wherein the plurality of sipes comprises at least a first lateral sipe extending laterally across the midsole.

3. The midsole of claim 2, wherein the first arcuate sipe intersects the first lateral sipe at the location in which the first diagonal sipe intersects the second diagonal sipe.

4. The midsole of claim 1, wherein the intermediate arcuate sipe and the plurality of shorter arcuate sipes do not intersect the first diagonal sipe and the second diagonal sipe.

5. The midsole of claim 1, wherein the plurality of arcuate sipes are parallel to each other.

6. The midsole of claim 1, wherein at least a portion of the first arcuate sipe is positioned laterally relative to the intermediate arcuate sipe and the plurality of shorter arcuate sipes.

7. The midsole of claim 1, wherein the plurality of sipes further comprises a plurality of lateral sipes and wherein each of the shorter arcuate sipes terminate at a lateral sipe and the intermediate arcuate sipe terminates at a successive lateral sipe.

8. The midsole of claim 1, wherein the intermediate arcuate sipe is positioned between the first arcuate sipe and the plurality of shorter arcuate sipes.

9. A midsole for an article of footwear, the midsole comprising:

a midsole body comprising a toe portion, a midfoot portion, and a heel portion;

a first surface and a second surface opposite the first surface, the midsole body extending between the first surface and the second surface; and a plurality of sipes extending from the first surface into the midsole body, the plurality of sipes comprising:

a plurality of arcuate sipes extending longitudinally, wherein the plurality of arcuate sipes comprises a first arcuate sipe having a first length extending from the toe portion to the heel portion, an intermediate arcuate sipe having a second length that is shorter than the first length, and a plurality of shorter arcuate sipes each having a third length that is shorter than the second length, a plurality of lateral sipes extending laterally across the midsole, and a first diagonal sipe and a second diagonal sipe, the first diagonal sipe intersecting the second diagonal sipe, wherein the plurality of lateral sipes includes a first lateral sipe that intersects the first diagonal sipe and the second diagonal sipe at a location in which the first diagonal sipe intersects with the second diagonal sipe, wherein the intermediate arcuate sipe, the plurality of shorter arcuate sipes, and at least a portion of the first arcuate sipe are parallel to a curvature of a lateral edge of the midsole.

10. The midsole of claim 9, wherein the plurality of lateral sipes are evenly spaced apart.

11. The midsole of claim 9, wherein the first arcuate sipe intersects the first diagonal sipe, the second diagonal sipe, and the first lateral sipe at the location in which the first diagonal sipe intersects with the second diagonal sipe.

12. The midsole of claim 9, wherein the location in which the first lateral sipe intersects with the first diagonal sipe and the second diagonal sipe is in the heel portion of the midsole.

13. A sole assembly for an article of footwear, the sole assembly comprising:

a midsole comprising:

a midsole body comprising a toe portion, a midfoot portion, and a heel portion;

a first surface and a second surface opposite the first surface, the midsole body extending between the first surface and the second surface; and a plurality of sipes extending from the first surface into the midsole body, the plurality of sipes comprising:

a first diagonal sipe and a second diagonal sipe, the first diagonal sipe intersecting the second diagonal sipe, and a plurality of arcuate sipes extending longitudinally, wherein the plurality of arcuate sipes comprises a first arcuate sipe having a first length extending from the toe portion to the heel portion, an intermediate arcuate sipe having a second length that is shorter than the first length, and a plurality of shorter arcuate sipes each having a third length that is shorter than the second length, wherein the first arcuate sipe intersects the first diagonal sipe and the second diagonal sipe at a location in which the first diagonal sipe intersects with the second diagonal sipe; and an outsole coupled to the midsole, wherein the intermediate arcuate sipe, the plurality of shorter arcuate sipes, and at least a portion of the first arcuate sipe are parallel to a curvature of a lateral edge of the midsole.

14. The sole assembly of claim 13, wherein the plurality of sipes further comprises at least one lateral sipe that intersects with the first arcuate sipe at the location in which the first diagonal sipe intersects with the second diagonal sipe.

15. The sole assembly of claim 14, wherein the location in which the first diagonal sipe intersects with the second diagonal sipe is in the heel portion.

16. The sole assembly of claim 13, wherein the first surface of the midsole faces toward the outsole.

* * * * *